United States Patent [19]

Bruney

[11] 4,204,092

[45] May 20, 1980

[54] AUDIO IMAGE RECOVERY SYSTEM

[76] Inventor: Paul F. Bruney, 3201 Rue Park Fontaine, New Orleans, La. 70114

[21] Appl. No.: 895,309

[22] Filed: Apr. 11, 1978

[51] Int. Cl.[2] ..... H04R 5/04

[52] U.S. Cl. ..... 179/1 G; 179/1 GQ

[58] Field of Search ..... 179/1 G, 1 GQ, 1 GP, 179/100.1 TD, 100.4 ST, 1 GA

[56] References Cited

U.S. PATENT DOCUMENTS

| | | | |
|---|---|---|---|
| 2,941,044 | 6/1960 | Volkmann | 179/1 G |
| 3,281,533 | 10/1966 | Pflager et al. | 179/1 G |
| 3,830,978 | 8/1974 | Odagi | 179/1 GQ |
| 4,024,344 | 5/1977 | Dolby et al. | 179/1 G |
| 4,034,158 | 7/1977 | Britton | 179/1 GQ |
| 4,053,711 | 10/1977 | DeFreitas et al. | 179/1 GQ |
| 4,060,696 | 11/1977 | Iwahara et al. | 179/1 GQ |
| 4,069,394 | 1/1978 | Doi et al. | 179/1 G |
| 4,097,688 | 6/1978 | Ochi | 179/1 GQ |
| 4,118,599 | 10/1978 | Iwahara et al. | 179/1 GQ |
| 4,121,059 | 10/1978 | Nakabayashi | 179/1 G |

OTHER PUBLICATIONS

"A Variable Stereo Suppression Control" by D'Errico in *Audio,* Aug. 1958, p. 23.

*Primary Examiner*—Douglas W. Olms

*Attorney, Agent, or Firm*—Thomas S. Keaty; Charles C. Garvey, Jr.

[57] ABSTRACT

A high fidelity playback system is described using a plurality of speakers in conjunction with a conventional stereo system and an auditory interface unit which provides improved high fidelity playback. The system includes for example, two front high fidelity speakers in the normal stereophonic position, and a second pair of high fidelity speakers placed on an axis defined by the ears of the listener. The amplifier feeds the front speakers directly. The interface unit attenuates the left and right channel signals according to the inter-channel signal level differential, and distributes them in proper proportion to the second pair of speakers to create full stereophonic realism with enhanced depth perception and positioning of the original sound sources.

Alternatively, only two speakers are used. The interface unit attenuates the left and right channel signals as before, selectively modifies portions of the signal on a frequency dependent basis, and delivers the resultant modified left and right channel information to the respective speakers.

6 Claims, 7 Drawing Figures

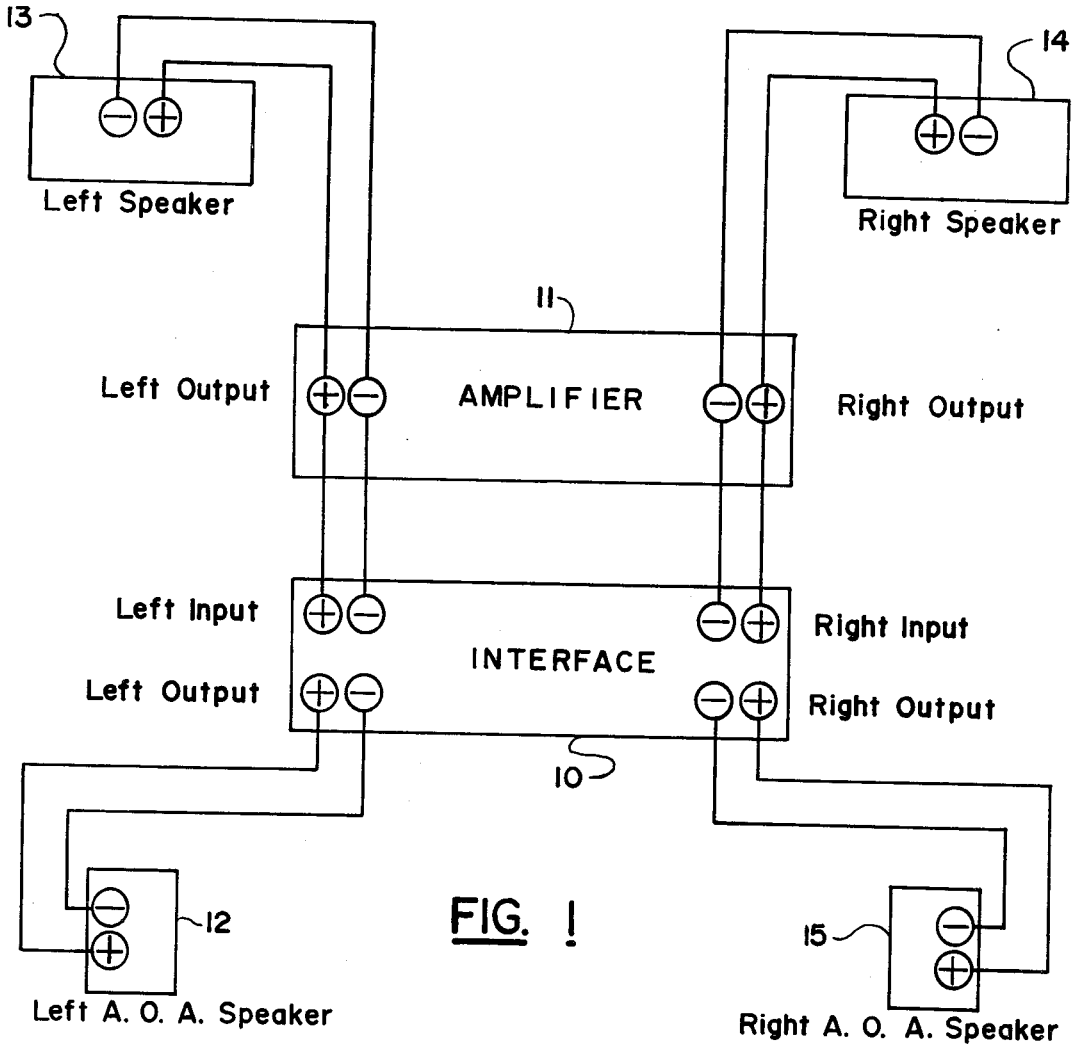
FIG. 1
FIG. 3
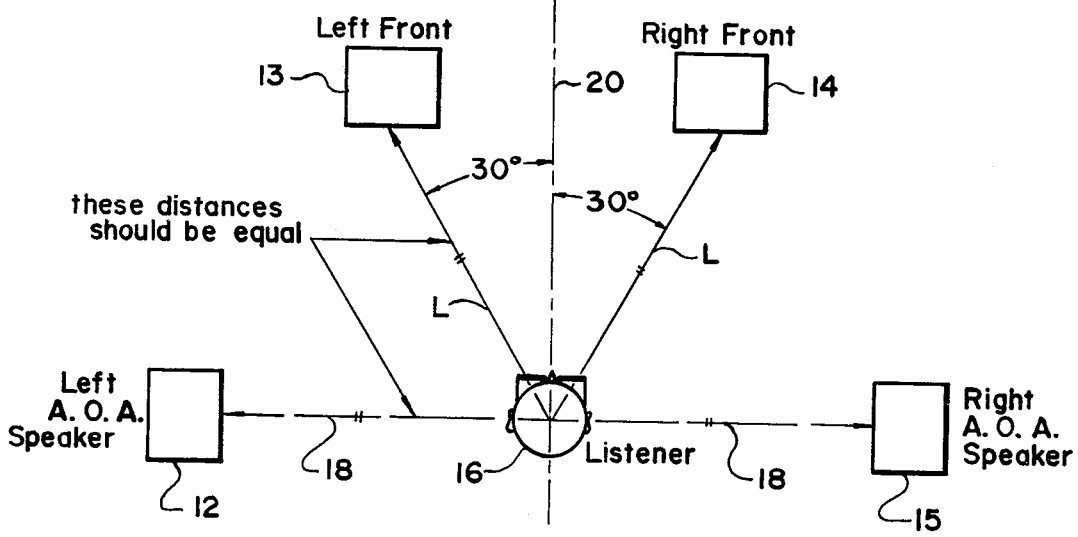

AUDIO IMAGE RECOVERY SYSTEM

BACKGROUND OF THE INVENTION

1. Field of the Invention

The present invention relates to systems for reproducing sound, and more particularly relates to a system for the reconstruction of pyscho-acoustic images in stereophonic sound reproduction systems.

2. General Background and Prior Art

Numerous prior publications and patents have disclosed systems and devices which have the objective of distortion free reproduction of recorded sonic materials typically in the home environment. These systems usually introduce some distortion.

One type of distortion is imaging distortion, typically manifested as a "flattening" of the sound stage image, that is, a tendency to hear as if they emanate from a single plane which when recorded were in widely scattered locations throughout the recording area, or stage sound sources. Even with the finest stereo system, one can sense only general depth, that is a vague "closer" or "farther" perception, regardless of the dispersion of the original sound sources. Because stereo systems use only two sound sources, the resultant imaging is necessarily different from randomly placed multiple sound sources.

One proposed, but impractical, "ideal" playback system uses one speaker for reproducing the sound of each source, each speaker being placed in the exact location originally occupied by the respective source with respect to the listener.

A more practical but less satisfactory approach is the well known quadraphonic system, in which separate information channels drive each of four speakers placed as to generally surround the listener. The conventional stereophonic system is simpler yet, but represents an even less satisfactory solution to the sound imaging problem.

These systems fail to accurately reproduce the sound image because they fail to take into consideration the manner in which the ears discern location in space. All sounds which strike the ear drums, or timpanic membrane, have first been partially supplemented by the wing of the outer ear, or auricle. The auricle functions as a reflector or funnel which modifies a portion of the sound entering the ear canal, or external auditory meatus, according to the direction and distance of the sound from the listener.

For a given sound originating in front of the listener, a certain portion of the sound ("direct-in" or D.I. signal) will enter the ear canal opening directly. Due to losses by multiple reflections as the sound travels through the ear canal, higher and lower frequencies will be attenuated relative to the mid-range frequencies according to the angle at which the sound subtends the opening. This attenuation is in addition to the characteristic attenuation of these frequencies due to the distance from the listener.

The other, usually much smaller portion of the sound reaching the timpanic membrane ("apparent-on-axis" or A.O.A., signal) will be reflected off the auricle, more or less directly into the ear canal by that section of the auricle directly adjacent to the ear canal opening and above the ear lobe. Because this sound component undergoes essentially a single reflection, it does not suffer the frequency abberations of the D.I. signal.

The subjective ratio of A.O.A. signal to D.I. signal is dependent upon both distance and angle of the sound source relative to the facing direction of the listener. The subjective level of A.O.A. signal increases as distance is reduced because of (1) an absolute level increase; (2) the high frequency levels increase relative to the mid-range level and, (3) to a lesser degree, low frequency levels increase relative to the mid-range level. High frequency information is lost through friction as it passes through air, and low frequency information is lost with distance because of the omnidirectionability of low frequency energy in air. Since level changes are more apparent to a listener at high frequencies than at lower frequencies, the listener thus hears both a subjectively and absolutely increasing A.O.A. component as the distance to the sound source is reduced.

The A.O.A. component also increases relative to the D.I. signal as the sound source moves closer to being in front of the listener. The D.I. component enters the meatus less directly and is therefore attenuated more before reaching the eardrum than is the reflected A.O.A. components.

As the A.O.A./D.I. ratio changes, the brain discriminates between angle and distance changes on the basis of the sound information of both ears. Simultaneous similar A.O.A. changes indicate distance change, while simultaneous dissimilar A.O.A. changes indicate change in the angular location of the source.

In addition, as distance is reduced, a subjective effect taught by the well known Fletcher-Munson curves comes into play. The relative levels of the higher and lower frequencies increase relative to mid-range because of increasing sound levels. It is hypothezied that this effect is intimately connected with the brain's ability to perceive the distance of a sound.

Conventional stereophonic systems do not take into account this sophisticated localizing function of the human ears. Although some localizing information is provided by level differences between two speakers, the illusion of location is imperfect and at best the sound stage image is flat. In fact, the listener tends to hear each speaker as a separate sound source. The quadraphonic system similarly does not address itself to this problem, and merely adds two more point sources.

While ideally all recordings should be made with the equivalent of two microphones close together so as to record the sound information which would be heard by two ears, many recordings are made with distantly spaced microphones and/or improper mixing techniques, and thus have lower than ideal interchannel crosstalk. Reproduced through conventional stereophonic systems these recordings have no discernable image.

When such non-ideal recordings are played through stereophonic speakers which have been "toed-in" (angled inward) image loss is less severe. However toe-in of front speakers creates overall incorrect image location (i.e. not according to what was recorded), and blurred sound information from sound sources located at center stage.

To date, apparently the most direct attempt to solve the audio image problem in stereophonic systems is disclosed in Sorkin U.S. Pat. No. 3,478,167, entitled "Three Speaker Stereophonic Audio System". That system comprises a conventional stereophonic audio system with an additional third speaker. This third speaker is placed directly in front of the listener and is fed with both left and right channel information, thus insuring that sound recorded from central sources will be played back through a centrally located speaker. The remaining two speakers are placed on either side of the listener and are fed with the respective left and right channel information as well as the inverted sound information of the opposite channel. The inventor claimed that the inverted signal cancelled the oppositely phased identical audio signal emanating from the opposite pair of speakers, to enhance in an undisclosed manner the stereophonic system.

However, this system does not provide A.O.A. and D.I. sound information in proper proportion and thus does not create the true three dimensional realism which the present invention does. The Sorkin system at best wraps the flattened sound stage image around the listener in an 180 degree arc. The Sorkin system creates further sound image confusion because of varying amounts of opposite channel cancellation arising from the sound shadowing of the listener's head and the directionality of the ears.

The present invention solves the soundstage imaging problem directly and with elegant simplicity. Other prior patents of possible interest are cited below:

PRIOR ART PATENTS

| U.S. Pat. No. | Patentee(s) | Issue Date |
|---|---|---|
| 2,710,662 | M. Camras | June 14, 1955 |
| 2,924,660 | Daniel Abrams | February 9, 1960 |
| 3,066,189 | R. H. Ranger | November 27, 1962 |
| 3,238,304 | Mitsura Yaita, et al | March 1, 1966 |
| 3,478,167 | M. Sorkin | Nov. 11, 1969 |
| 3,710,034 | E. J. Murry | January 9, 1973 |
| 3,725,586 | Kazumi Iida | April 3, 1973 |
| 3,892,624 | Satoshi Shimada | July 1, 1975 |
| 3,892,917 | Hiromi Sotome | July 1, 1975 |
| 3,985,960 | Robert Lee Wallace, Jr. | October 12, 1976 |

BRIEF DISCUSSION OF INVENTION

The interface system of the present invention solves the problem of accurate audio image recreation by reproducing both D.I. and A.O.A. sound and delivering them to the listener's ears in the proper proportion for accurate reconstruction of the image. In the preferred embodiment a two mode interface device is connected in parallel with the front speakers of an existing or standard stereo system. While interface devices performing a similar function may be constructed with any of a variety of electronic components, the preferred embodiment described here was designed for simplicity, while occupying a point of moderation between maximum effectiveness and minimum expense. Two additional speakers are conected to the outputs to provide A.O.A. sound, which may be adjusted to accommodate a variety of loud speaker placement geometries and efficiencies.

A Depth of Field Ratio ("D.O.F." Ratio) circuit connected between the inputs provides partial signal shunting to ground when the audio information in each channel is different, corresponding to off-center stage sound. Focus circuits connect the D.O.F. Ratio circuit to the outputs and allow for varying the level of sound information of the A.O.A. speakers. Thus, as the sound information from a given recorded source tends to shift more and more into one channel, corresponding to the source moving off to the side of the listener, the interface device shunts to ground and thus attenuates more of that portion of the sound information which is delivered to the A.O.A. speakers. The ratio of D.I. to A.O.A. sound is thus changed in a manner corresponding to real life listening.

In the alternative mode a Mix Width circuit provides a variable interchannel mixing of the A.O.A. sound. Additional variable resistances are added in series to the D.O.F. Ratio and Focus circuits ("Mix D.O.F. Ratio" and "Mix Focus" resistors, respectively), to compensate for the effect of adding the Mix Width circuit.

Depth of Field Ratio ("D.O.F. Ratio") and Focus controls are adjusted to provide an overall sound stage image of a proper depth with most accurate focus of separate sources. This is accomplished by adjusting the D.O.F. Ratio Control to attenuate the left and right channels in the proper amount according to the interchannel signal level differential to provide a satisfactory stage depth, and for that setting adjusting the Focus controls to provide A.O.A. signals at the proper level for such a stage configuration. In the alternative mode, the additional Mix Width control varies the left and right A.O.A. signal intermix and thus varies the width of the stage image. Focusing and Depth of Field adjustments in the alternative mode are made with the Mix Focus and Mix D.O.F. Ratio Controls, respectively. In addition to focusing the sound sources, changing the focus control has a secondary effect of tending to move the stage image closer or farther away.

Variations in the basic circuit, discussed above, allow two speaker operation, either both in front, or one on either side of the listener. In the latter case, D.I. sound must be re-created. This is accomplished by dividing the D.O.F. Ratio circuit into symmetrical halves and using the mid-point as a pick-up point for a variable filter which duplicates, as closely as possible, the frequency-dependent attenuation of the D.I. sound due to outer ear functions. While, ideally this would be a bandpass filter tailored to the individual's ear, a low pass filter with an adjustable cut-off point provides a sufficient approximation for satisfactory results. The filtered signal is then re-joined to the left and right signal paths through variable resistances ("D.I./A.O.A. Ratio" resistances) which allow for proper balance of the D.I. and A.O.A. signals.

In the former case, A.O.A. sound must be recreated. Again, the D.O.F. Ratio circuit is divided. Here, however, a resistor or direct connection joins the pick up point to the D.I./A.O.A. Ratio circuit. A.O.A. sound non-attenuation is simulated by circuits which boost the high and low frequencies, so that by the time the sounds emanating from the front speakers reach the eardrum, they are restored to A.O.A. levels. It is found that a single high pass filter connected in the signal path of each channel, between the D.O.F. Ratio and D.I./A.O.A. Ratio circuits provides a sufficient approximation of this effect for satisfactory results.

Finally, by placing variable loudness contour circuits, well known in the art, in the main signal paths of both channels, a stage distance control function is provided. In the present invention increasing the pass band shaping effect of the loudness contour circuit pass band decreases the perceived distance of the sound image from the listener. It is believed that this perceived effect is related to the effect recorded in the Fletcher-Munson curves, and may be utilized only when "complete", i.e., combined D.I. and A.O.A. sound information is provided.

BRIEF DESCRIPTION OF DRAWINGS

For a further understanding of the nature and objects of the present invention, reference should be had to the following detailed description, taken in conjunction with the accompanying drawings, in which like parts are given like reference numerals and wherein:

FIG. 1 is a schematic view illustrating a typical hook-up for the interface apparatus and speakers of the preferred embodiment of the present invention;

FIG. 3 is a schematic plan view showing a typical transducer placement for use with the preferred embodiment of the apparatus of the present invention;

FIG. 5 is a circuit diagram showing an alternative embodiment of the interface apparatus, for use with two speakers placed on either side of the listener's head; while

DETAILED DESCRIPTION OF PREFERRED EMBODIMENT

Figure 2:
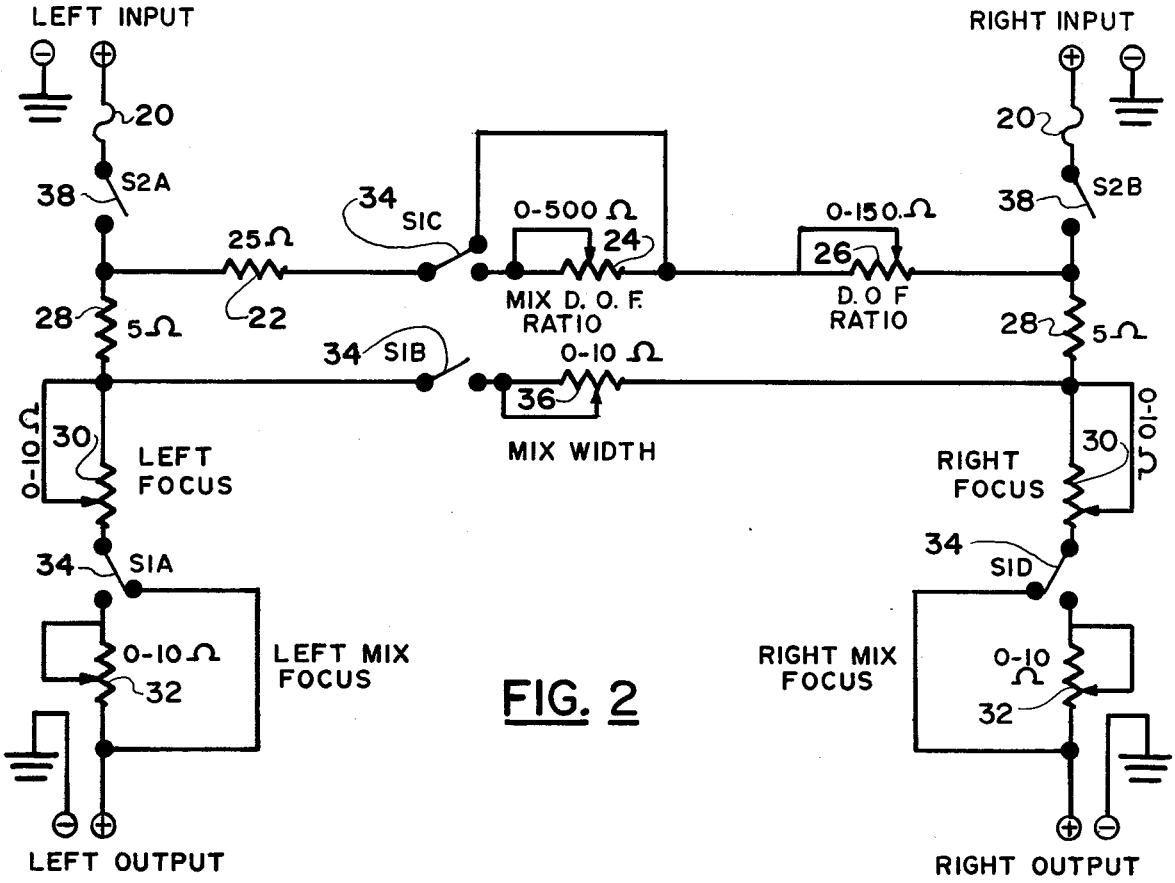
FIG. 2 is a circuit diagram showing a preferred embodiment of the interface apparatus of the present invention.

In FIG. 3 there can be seen a plan view of a typical transducer placement using the preferred embodiment of the interface apparatus 10 (illustrated in FIGS. 1 & 2) of the present invention. In FIG. 3 there can be seen a plurality of transducers 12–15 which are arranged in a desired pattern. Each transducer 12–15 is, in the preferred embodiment, a conventional high fidelity type speaker. In FIG. 3, each of the speakers is placed so that two front speaker units 13, 14 are provided and two side or A.O.A. speaker units 12, 15 are provided. Note that the position of the listener 16 is also schematically shown in FIG. 3.

The position of the listener with respect to the plurality of speaker units 12, 15 can be better understood by an inspection of axis 18 which represents the "apparent-on-axis", or "A.O.A." axis. Approximately perpendicular to the A.O.A. axis 18 can be seen axis 20 which represents generally the line of sight of listener 16.

In FIG. 3 there can be seen a schematic illustration of the distance "L" which represents the linear distance between the listener 16 and each respective speaker 12–15. In the preferred embodiment, each distance "L" would be substantially equal.

It is preferred that with respect to listener 16 the front speakers 13, 14 be placed at an angular displacement of approximately 30 degrees relative to the axis 20 as can be seen in FIG. 3. Each front speaker 13, 14 would be faced forward (i.e., its axis parallel to that of axis 20). The front speaker preferrably should not be toed-in as such toeing-in would cause blurring the details of those sounds which were "center-staged". Likewise, toeing-in of the front speakers 13, 14 would allow both ears to hear each speaker and to determine the speaker location in the room. This is contrary to the final goal of the system 10, i.e., the precise placement reproduced sounds rather than the precise placement of the playback loudspeakers 13 and 14.

Thus oriented, the front speakers 13, 14 provide only left versus right sound source placement, or lateral placement with respect to axis 20.

Side speakers 12, 15 would be preferrably aligned directly on the axis of the ear canal of the listener 16. This axis is shown in FIG. 3 schematically as axis 18. The placement of side speakers 12, 15 should be done with care taken to minimize reflected sound and preferrably to place the speakers at the same distance "L" from the listener as the front speakers. Note that this overall distance L to each speaker 12–15 is shown in FIG. 3. This equidistant placement of speakers 12–15 with respect to listener 16 is useful to minimize the loss of detail due to phase differentials among the audio signals reaching the listener from the various speakers.

FIG. 1 shows an embodiment of the system, the front speakers 13, 14 connected to a stereophonic audio generating source 11, being a conventional stereo amplifier in the preferred embodiment as shown. The interface 10 is connected to amplifier outputs in parallel with the front speakers.

Interface 10 is essentially a adjustable left and right variable attenuation circuit with level controls for the side speakers, allowing the side A.O.A. speakers 12, 15 to perform the function of the outer ear on playback. In the normal mode, the interface 10 is optimized for recordings made with two microphones placed close together (in the neighborhood of five to six inches), or with a single stereo microphone. Recordings made in this way preserve proper perspective of instruments (i.e., precedence information, frequency response and level changes which occur with distance). Adding the outer ear functions is all that is necessary to provide the listener with accurate spacial presentation on playback with loudspeakers. The interface 10 in conjunction with the side speakers 12, 15 performs these functions.

Also included in the interface device is an alternative mode function for regular "mixed" recordings which do not preserve all of the natural perspective information, but which do contain distance information, especially frequency response and level changes which are a function of the distance of the performer from the microphone. Adjustments are provided to calibrate the interface to the recording, and also to compensate for the placement of the front speakers 13, 14 (i.e., their separation and angular placement relative to the listener's ears).

FIG. 2 is a schematic diagram of the preferred embodiment of the interface device.

Values of resistances and rheostats were determined experimentally, with care taken that, in the condition of lowest resistance values, the interface itself would not present to the amplifier 11 an impedance lower than 8 ohms. Thus, the amplifier 11 is presented a minimum load of 4 ohms, assuming 8 ohm front stereo speakers.

The circuit allows for switching between the two different modes of operation by way of a four pole double throw switch 34. The schematic shows the circuit switch in the normal mode of operation.

In the normal mode the left and right inputs are connected through the D.O.F. ratio control circuit comprising the D.O.F. Ratio Control rheostat 26, and a fixed resistance 22 which establishes the minimum resistance of the D.O.F. Ratio Control Circuit. This circuit attenuates the left and right input signals in varying amounts according to the inter-channel signal level differential and the setting of the D.O.F. Ratio Control rheostat 26, by providing amplifier loading which varies according to the signal level differences between channels.

The variable attenuation which occurs in the ratio circuit is caused by varying potentials on the hot amplifier outputs. If, for instance, there is no potential on a hot amplifier terminal, the terminal behaves as a virtual ground because of the amplifier's low internal impedance. This additional ground path (whose impedance changes with channel balance) reduces the amount of power available to the appropriate side speaker. The left and right input signals are fed to the left and right output through the left and right Focus circuits, respectively. The Focus circuits comprise Focus rheostats 30 and fixed resistances 28 in series with the Focus rheostats 30.

The Focus circuits deliver the A.O.A. signals to the outputs at the proper level, determined by the setting of Focus rheostats 30.

In the alternative mode a Mix D.O.F. Ratio Control rheostat 24 is added in series to the D.O.F. Ratio Control circuit. The modified left and right input signals are fed to a Mix Width circuit, comprising Mix Width rheostat 36, through isolation circuits comprising fixed resistances of equal values 28. The Mix Width circuit mixes the modified left and right signals in varying amounts according to the setting of the Mix Width rheostat 36. The Mix D.O.F. Ratio Control rheostat 24 adds a variable resistance to the D.O.F. Ratio Control to compensate for the Mix Width circuit resistance which, when added, tends to lower the overall resistance between the left and right inputs.

The left and right signals are then fed to the left and right outputs through left and right Focus circuits respectively, comprising left and right Focus rheostats 30 and left and right Mix Focus rheostats 32. Again, the Focus circuits deliver the A.O.A. signals to the outputs at the proper level, determined by the setting of Focus rheostats 30, and the Mix Focus rheostats 32. The Mix Focus rheostats 32 are necessary to permit production of A.O.A. signals at the level appropriate for "mixed" recordings.

Negative terminal connections are all made through ground. Both inputs have series fuses 20 and an On/Off Switch 38, being a double pole single throw switch. The fuse 20 sizes and the power ratings of the device components are selected according to the power ratings of the amplifier 11 and speakers 12–15.

Figure 4:
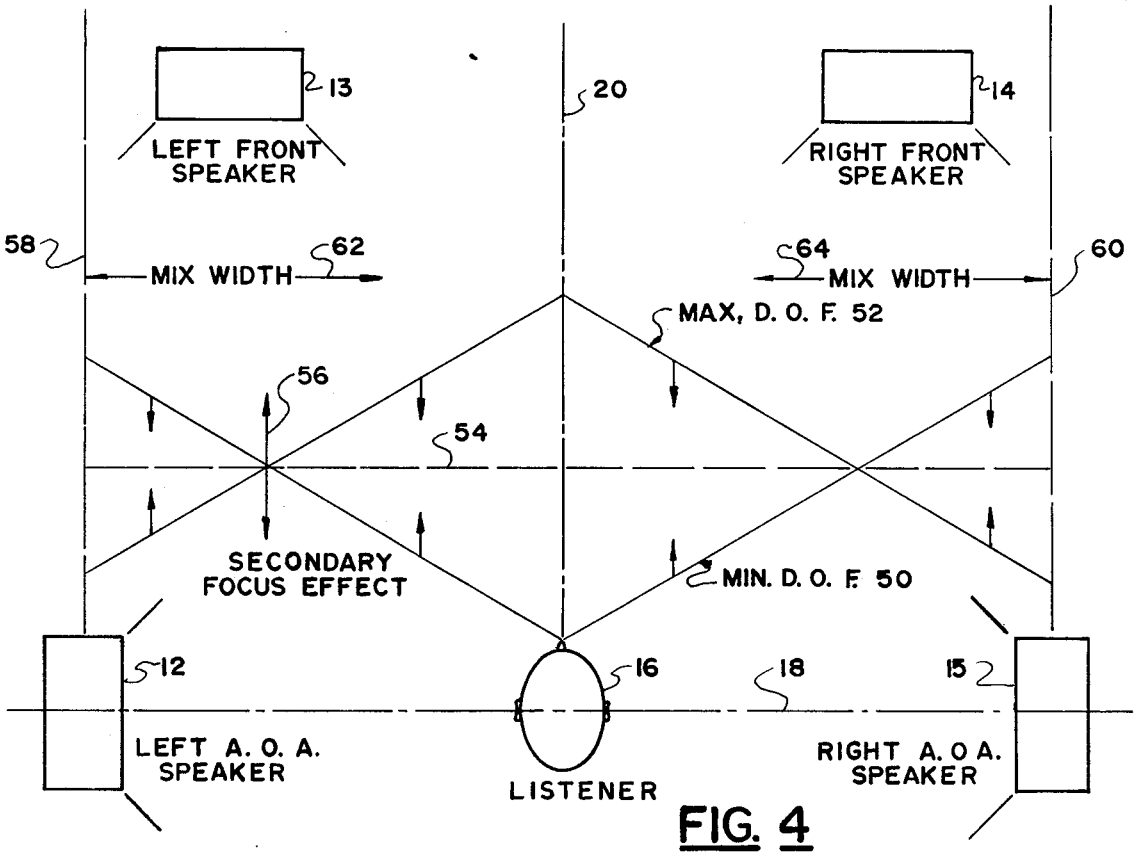
FIG. 4 is a schematic plan view showing the effect of the various controls on the front of the sound stage image.

FIG. 4 is a plan view which shows the effect on the front of the reproduced sound stage image. When the system is properly adjusted, the stage image fills the area behind stage front.

As can be seen, the D.O.F. Ratio Control varies the relative front-to-back placement of the center of the stage with respect to the stage sides between a minimum 50 and a maximum 52 value. Intermediate is a linear stage front 54.

As indicated above, the primary function of the focus Control is to focus the point sound source images. Position arrows 52 show the secondary effect of adjusting the focus control, that is moving the stage front closer or farther away.

Figure 5:
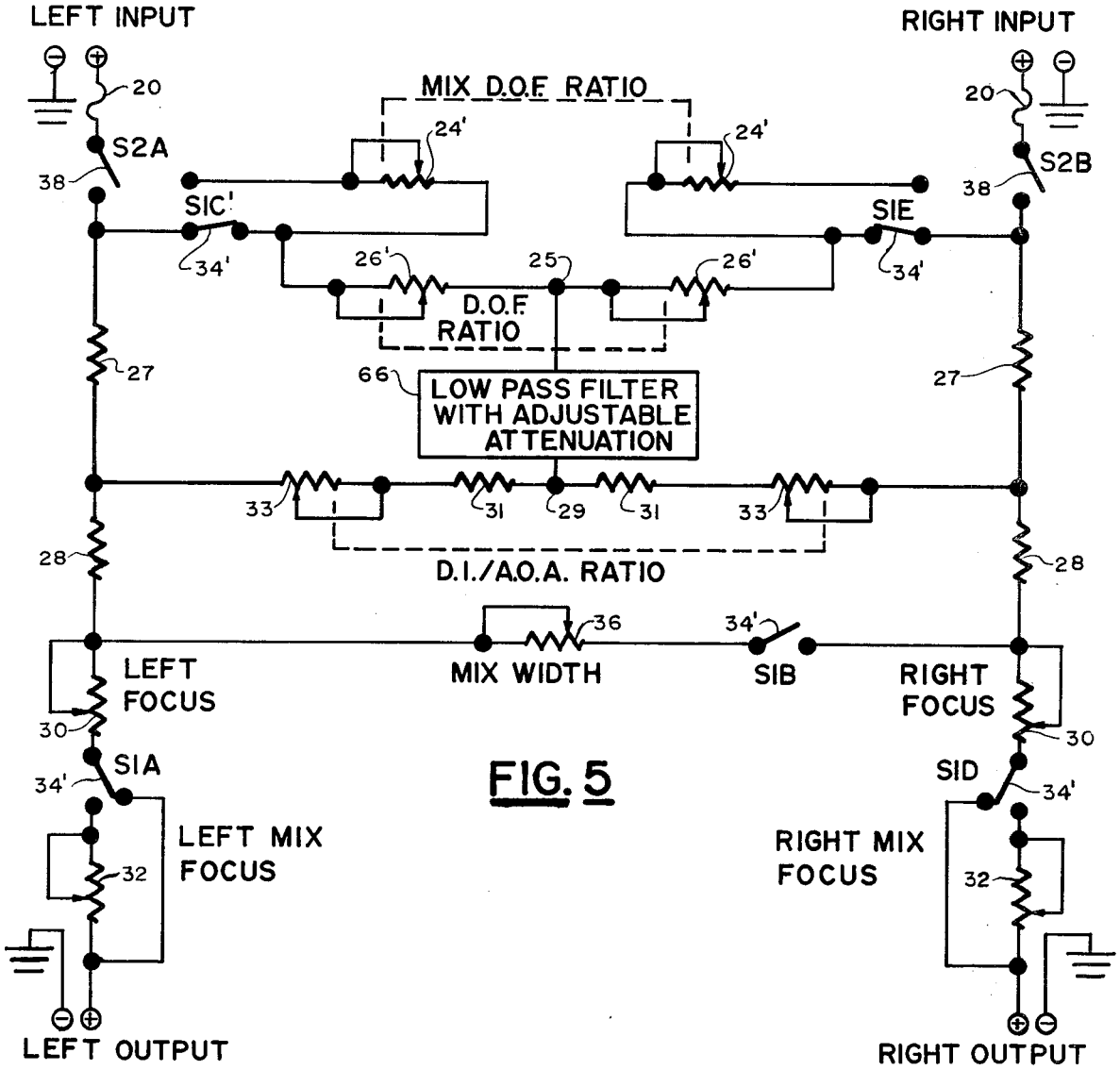
Figure 6:
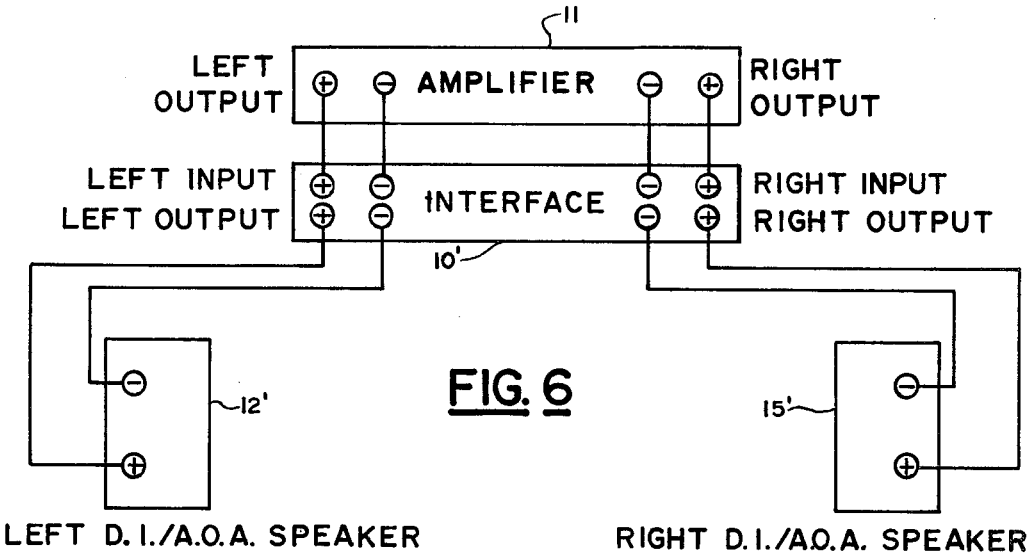
FIG. 6 is a schematic view illustration hook-up of the interface apparatus of the present invention in two speaker configuration.

FIG. 5 is a schematic diagram of an alternative embodiment of the present invention for use with two speakers, one on either side of the listener's head. FIG. 6 shows the interconnections for such a system.

D.O.F. Ratio and Mix D.O.F. Ratio circuits are divided symetrically at pick-up point 25. A variable low pass filter 66 connects pick-up point 25 to the mid point 29 of D.I./A.O.A. Ratio Circuit. Isolation resistors 27 connect the inputs to the D.I./A.O.A. Ratio Circuits. Rheostats 33, which may be ganged, as shown, vary the level of the filtered signal which returns to the left and right signal paths. Resistors 31 limit the lowest level of the resistance in the D.I./A.O.A. ratio circuit.

D.O.F. ratio and Mix D.O.F. Ratio rheostats, 26' and 24', may also be ganged as shown.

As can be seen, the remainder of the circuit is identical to that of the preferred embodiment shown in FIG. 2, with the exception that switch 34' is a five pole double throw switch.

Figure 7:
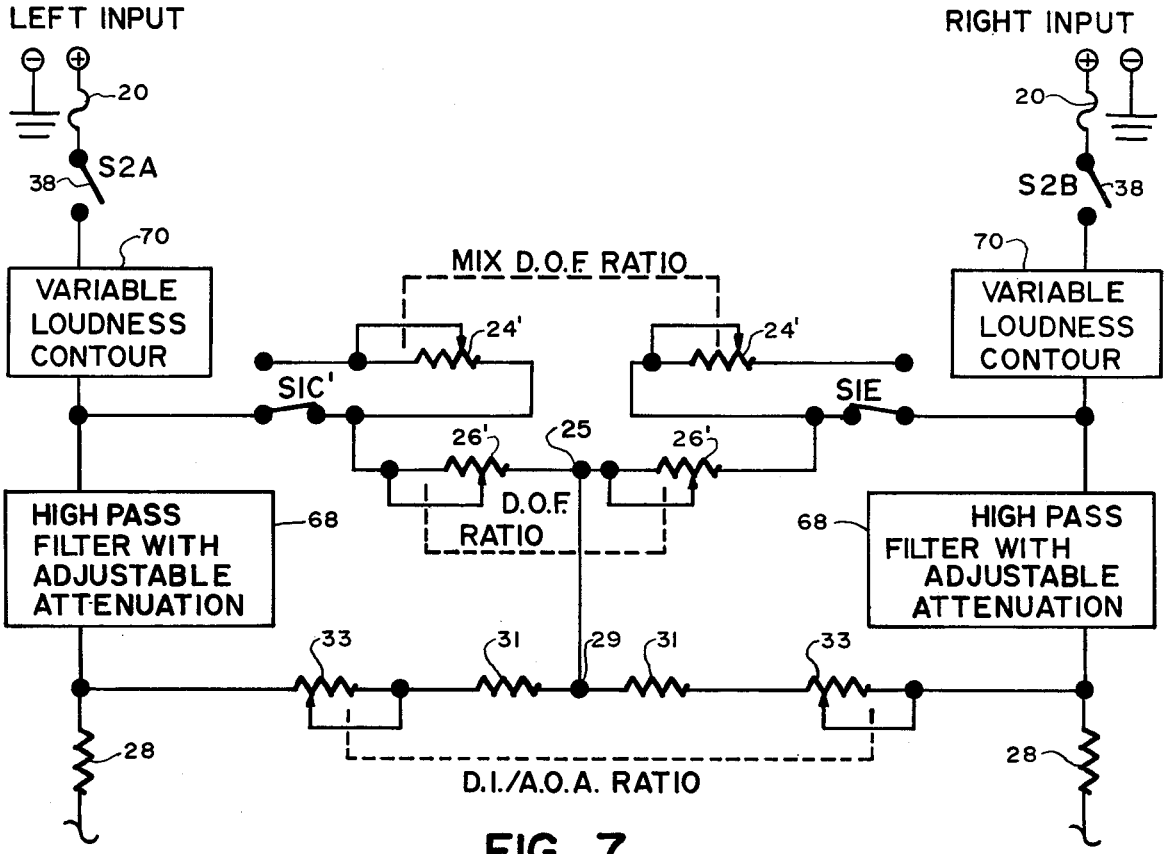
FIG. 7 is a circuit diagram of the first stage of an alternative embodiment of the interface apparatus for use with two speakers placed in front of the listener.

FIG. 7 is a schematic diagram showing an alternative embodiment of the present invention for use with two speakers placed in front of the listener, as for conventional stereophonic listening. Since the remainder of the circuit, from resistors 28 on, is identical to that of FIG. 5, it has been omitted in this diagram. Interconnections for such a system are the same as shown in FIG. 6.

D.O.F. Ratio and Mix D.O.F. Ratio circuits are again divided symmetrically at pick-up point 25, which is here directly connected to mid point 29 of D.I./A.O.A. Ratio circuit, Variable high pass filters 68 connect the inputs to the D.I./A.O.A., circuits, as shown.

FIG. 7 also shows an additional function which may be added to any of the embodiments of the present invention. Variable loudness contour circuits 70 may be placed in the system in the main signal paths of each channel, between the signal source and all active speakers. Varying the bandpass shapping effect varies perceived distance to the sound source. This completes the description of the embodiment illustrated herein. However, this invention is not limited to the particular details of constructions, components and processes described as many equivalents will suggest themselves to those schooled in the art. For example, each Isolation circuit might comprise an amplifier. Also, the transducers might be mounted in headphones. It is accordingly desired that the appended claims be given a broad interpretation commensurate with the scope of the invention within the art.

What is claimed is:

1. An audio-image system for use by a listener comprising:

(a) first left and right transducer means generally laterally placed with respect to the listener for converting received audio signals to sound;

(b) left and right signal means for providing left and right stereophonic audio electrical signals;

(c) spaced second left and right transducer means placed generally forward of the listener for converting received audio signal to sound;

(d) an interface circuit associated with said first and said second transducer means and with said signal means, said interface circuit providing, (1) means for dividing both of said left and right stereophonic audio electrical signals into two sound components each, a direct in sound component and a reflected sound component, (2) a variable attenuation circuit providing means for attenuating said left and right signals in varying amounts according to audio electrical signal level differences between them, (3) transmission connection means for providing said left and right divided signals to said first left and right transducers and to said second left and right transducers with said left stereophonic signal being transmitted over said transmission connection means to the left transducer portions of said first and second transducer means, the reflected sound component being transmitted to said first lateral left transducer means and the direct in sound component being transmitted to said second forward left transducer means and said right stereophonic signal is correspondingly transmitted over said transmission connection means to the right transducer portions of said first and second transducer means, the reflected component and direct in component being transmitted respectively to said right lateral and right forward transducer portions.

2. An audio-image system for use by a listener comprising:

(a) first left and right transducer means providing left and right speakers spaced and laterally placed respectively on the sides of the listener for converting audio electrical signals to sound;

(b) left and right signal means for providing left and right audio electrical signals; and (c) second left and right transducer means providing left and right spaced speakers placed respectively left forward and right forward of the listener for converting audio electrical signals to sound;

(d) an interface circuit connecting to said second left and right transducer means and connecting said left and right signal means, respectively, to said first left and right transducer means; said interface circuit comprising (1) a variable attenuation circuit providing means for attenuating said left and right signals in varying amounts according to audio electrical signal level differences between them; and (2) left and right feed circuits providing means for feeding said left and right variably attenuated signals to said left and right transducer means at selectively variable levels, respectively.

3. An audio image system according to claim 2 wherein said interface circuit further provides a mix circuit associated with said interface circuit, said mix circuit providing means for variably intermixing said attenuated left and right signals and feeding said variably intermixed left and right signals to said transducers at said selectively variable levels.

4. An audio-image system according to claims 2 or 3 wherein said second left and right transducer means comprise left and right audio speakers placed in front of and to either side of the listener and connected directly to said left and right signal means and said first left and right transducer means comprises left and right audio speakers placed one on each side of the listener's head respectively and connected to the left and right feed circuits, respectively.

5. An audio-image system according to claim 4 wherein:

(a) said left and right front audio speakers are placed at equal speaker distances from the listener; and (b) said left and right side audio speakers are placed on an axis line passing approximately through the listener's ears and each at the same distance from the listener as each of the front speakers.

6. An audio image system according to claim 5 where said left and right front speakers are placed on lines subtending horizontal angles of 30° with respect to the line of sight of the listener.

* * * * *